US005724642A

United States Patent [19]

Cala

[11] Patent Number: 5,724,642

[45] Date of Patent: Mar. 3, 1998

[54] DUPLEX COLOR PRINTING SYSTEM WITH CURL CONTROL BY SHEET ROTATION BETWEEN PRINTING OPPOSING SIDES

[75] Inventor: Gerald F. Cala, Rochester, N.Y.

[73] Assignee: Xerox Corporation, Stamford, Conn.

[21] Appl. No.: 719,531

[22] Filed: Sep. 27, 1996

[51] Int. Cl.[6] ..... G03G 21/00

[52] U.S. Cl. ..... 399/364; 399/406; 399/397; 399/298; 271/184

[58] Field of Search ..... 399/397, 406, 399/364, 298; 271/184, 185

[56] References Cited

U.S. PATENT DOCUMENTS

| | | | |
|---|---|---|---|
| 4,877,234 | 10/1989 | Mandel | 271/225 |
| 4,955,965 | 9/1990 | Mandel | 271/225 |
| 5,090,683 | 2/1992 | Kamath et al. | 271/271 |
| 5,224,696 | 7/1993 | Kellum | 271/184 |
| 5,445,592 | 8/1995 | Richards | 493/444 |
| 5,461,469 | 10/1995 | Farrell . | |

OTHER PUBLICATIONS

Xerox Disclosure Journal, vol. 9, No. 5, Sep./Oct., 1984, p. 323 "Copy Rotator/Inverter", Author: R.E. Shaeffer.

*Primary Examiner*—R. L. Moses

[57] ABSTRACT

A system of improved duplex color printing by reducing copy sheet feeding jams due to first side color printing sheet curl by feeding and printing a first plural color image on a first side of a copy sheet with the copy sheet in a first orientation, then automatically rotating the copy sheet by 90 degrees from the first orientation into a second orientation and feeding and printing a second plural color image on the second side of the copy sheet with the copy sheet in the second orientation. Additionally disclosed is, in coordination therewith, automatically rotating the image for the second side of the copy sheet by 90 degrees from the first plural color image for the printing of the second plural color image on the second side of the copy sheet with the copy sheet in the second orientation, so that commonly oriented images are provided on the first and second sides of the copy sheet. The first printing pass orientation of the copy sheet may be long edge first, and the second short edge first.

6 Claims, 1 Drawing Sheet

Figure 1:
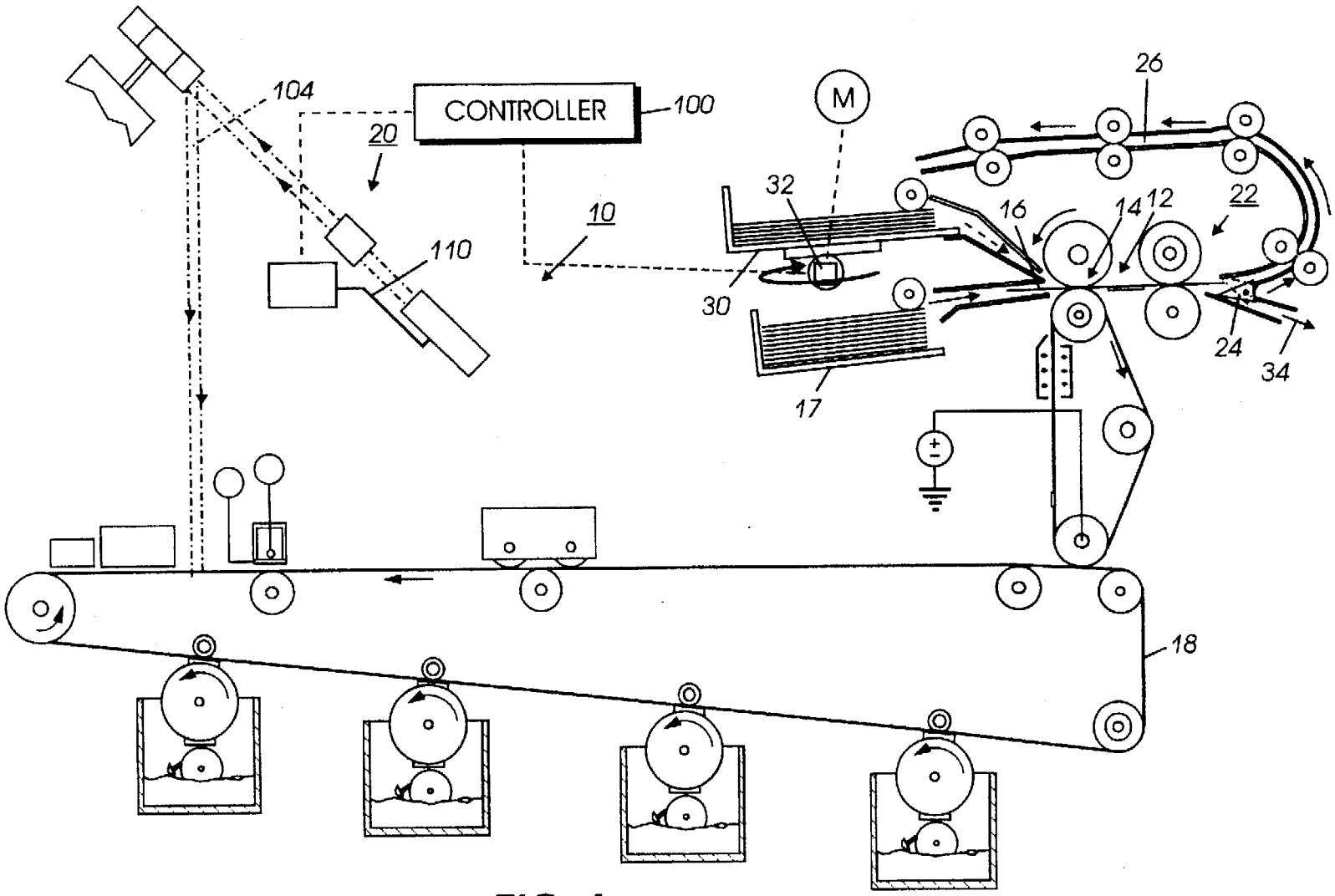

DUPLEX COLOR PRINTING SYSTEM WITH CURL CONTROL BY SHEET ROTATION BETWEEN PRINTING OPPOSING SIDES

Disclosed herein is an improved system for two pass duplex color printing, with reduced color printed copy sheets curling problems which can cause sheet feeding jams, especially on the second printing pass of the second side.

By way of background, in two pass duplex color printing, especially in a xerographic or other such plural color duplex reproduction apparatus, plural color images are printed on both the first and second sides of copy sheets, but this is done one side at a time, typically by passing the printed sheet with layers of colored toner thereon through a heated fuser roll system to fuse the first side image after the first side printing, which is known to cause substantial curling and/or cockling of such copy sheets in curl characteristics or directions which can cause these sheets to jam in the paper path of the color duplex reproduction apparatus during the feeding for printing of these curled sheets through the reproduction apparatus for printing their second sides. Although there are numerous patents on various sheet decurling systems, it is very difficult to account for differences in sheet humidity content and temperature before and after fusing, differences in the extent of solid area toner coverage and thickness with different images, differences in toner fusing or plasticising, variations in the paper or plastic image substrate sheet type and thickness, etc., any of which can affect sheet curl.

Accordingly, disclosed in the embodiments herein is a system of reducing such copy sheet feeding jams due first side color printing sheet curl by feeding and printing a first plural color image on a first side of a copy sheet with the copy sheet in a first orientation, then automatically rotating the copy sheet by 90 degrees from the first orientation into a second orientation and feeding and printing a second plural color image on the second side of the copy sheet with the copy sheet going through the system in the second orientation. Further additionally disclosed is, in coordination therewith, automatically rotating the image for the second side of the copy sheet by 90 degrees from the first plural color image for the printing of the second plural color image on the second side of the copy sheet with the copy sheet in said second orientation, so that commonly oriented images are provided on the first and second sides of the copy sheet. Preferably the first orientation of the copy sheet is long edge first, and the second orientation is short edge first, since long edge first sheet feeding and printing is the most rapid or productive and this will be compatible with preferred simplex (one side only) printing.

Further by way of background, various means of copy sheet rotation are known per se and need not be explained in detail herein. One example of sheet rotation for duplex printing, albeit for 180 degree rather than 90 degree rotation, is disclosed in a Xerox Disclosure Journal publication of September/October 1984, Vol. 9, No. 5, pp. 323–324, by R. E. Shaeffer, "Copy Rotator/Inverter". Individual or one sheet at a time sheet rotation is shown there, but it is also believed to be know from another prior publication to rotate an entire duplex buffer tray of plural sheets in a duplex paper path before their second side printing by 180 degrees. Xerox Corp. U.S. patents on 90 degree sheet rotators per se include U.S. Pat. Nos. 5,090,683; 4,955,965; 4,877,234, and other art cited therein. Electronic image rotation by 90 degrees (portrait to landscape mode) is also known per se and need not be described herein. E.g., Xerox Corp. U.S. Pat. No. 4,703,551 issued Oct. 27, 1987 to A. Baroody. Printing different copy sheets with 90 degree different orientations of the sheets (for different reasons) is taught in Xerox Corp. U.S. Pat. No. 5,316,279.

Color printers, including the example shown herein, are well known per se, and need not be described in detail herein. Some examples are in Xerox Corp. U.S. Pat. No. 5,539,511 issued Jul. 23, 1996 and U.S. Pat. No. 5,278,615 issued Jan. 11, 1994. Various other color printing systems are known, e.g. U.S. Pat. No. 4,652,115.

A specific feature of the specific embodiment disclosed herein is to provide, in a duplex color printing system, in which first and second plural color images are respectively printed on the first and second sides of copy sheets, one side at a time, a system of reducing copy sheet feeding jams due to color printing sheet curl by feeding and printing a first plural color image on a first side of a copy sheet with said copy sheet in a first orientation, then automatically rotating said copy sheet by 90 degrees from said first orientation into a second orientation and feeding and printing said copy sheet to print a second plural color image on the second side of said copy sheet with the copy sheet in said second orientation.

Further specific features disclosed herein, individually or in combination, include those wherein said second plural color image is automatically correspondingly rotated by 90 degrees from said first plural color image for said printing of said second plural color image on said second side of said copy sheet with said copy sheet in said second orientation so that commonly oriented images are provided on said first and second sides of said copy sheet; and/or wherein said first orientation of said copy sheet is long edge first, and said second orientation is short edge first; and/or wherein respective first and second plural color images are printed on both the first and second sides of copy sheets one side at a time in a duplex color printer, said duplex color printer including a printing sheet path and a duplex sheet path system for feeding sheets printed on their first sides back to be printed on their second sides; comprising a system for reducing copy sheet feeding jams due to color printing sheet curl, wherein said printing sheet path feeds and prints said first plural color image on a first side of a copy sheet with said copy sheet in a first orientation and then feeds said sheet into said duplex sheet path system; said duplex sheet path system includes a sheet rotation system which automatically rotates said copy sheet by 90 degrees from said first orientation into a second orientation and feeds said sheet in said second orientation back to said printing sheet path to print said second plural color image on the second side of said copy sheet with said copy sheet in said second orientation; and/or wherein said duplex color printer automatically electronically rotates said second plural color image by 90 degrees from said first plural color image for said printing of said second plural color image on said second side of said copy sheet corresponding with said rotation of said copy sheet in said second orientation so that commonly oriented images are provided on said first and second sides of said copy sheet; and/or wherein said first orientation of said copy sheet is long edge first, and said second orientation is short edge first.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc.. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related. A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing FIGURE (approximately to scale) wherein:

FIG. 1 (the FIGURE) is a frontal schematic view of an otherwise known duplex color printer modified in accordance with one example of the subject system, in this example, with a 90 degree automatically rotatable duplex buffer tray controlled by the printer controller.

Referring to the example of the FIGURE, there is shown, merely as one example, a duplex color printer 10 with, conventionally, a printing path 12 including an image transfer station 14 for transferring images to one side of sheets 16 fed sequentially from a sheet feeding tray 17. The images are transferred to the sheet 16 (in this example indirectly via a conventional intermediate image transfer belt system) from a photoreceptor 18 which is exposed by a laser system 20 controlled by the printer controller 100 and developed with different color toners by respective development stations. After transfer 14 sheets 16 then pass through a fuser 22. Then, for second side (duplex) printing, the sheets 16 are deflected by a gate 24 into a duplex path 26 which conventionally includes a sheet inversion loop path to feed the sheets 16 back to the input side of the printing path 12 and temporarily into a duplex buffer tray system 30. Here, unconventionally, the duplex tray system 30 has a rotational system 32 controlled by controller 100 to selectably rotate the tray 30 by 90 degrees (at right angles) and back at the appropriate times as described above for the reasons explained above. The sheets 16 are then fed out from duplex tray 30 both inverted and rotated in orientation back into the printing path 12 for printing their second or opposite sides, and outputted at 34, i.e., the gate 24 this time is not actuated and the sheets 16 do not go into the duplex path 26. Preferably, the sheets 16 are fed long edge first (widthwise) from tray 17 for their first side printing, since that is the most efficient in copying rate and commonly desired for simplex printing, and then, by the rotation 32 of duplex tray 30 and its content of a set of sheets 16 printed on their side one, the sheets 16 are printed short edge first on their side two. Preferably, for this second side printing, the controller 100 also correspondingly rotates the electronic image being applied to the laser system 20 in a known manner, so that the opposite side images will be commonly right reading, unless of course, one page was intended from the original image set to be printed in landscape mode rather than portrait mode.

While the embodiment disclosed herein is preferred, it will be appreciated from this teaching that various alternatives, modifications, variations or improvements therein may be made by those skilled in the art, which are intended to be encompassed by the following claims:

I claim:

1. In a duplex color printing system, in which first and second plural color images are respectively printed on the first and second sides of copy sheets fed to be printed one side at a time, a process of reducing copy sheet feeding jams due to color printing sheet curl; the improvement comprising:

printing a first plural color image on a first side of a copy sheet with said copy sheet in a first orientation, then automatically rotating said copy sheet by 90 degrees from said first orientation into a second orientation and printing said copy sheet to print a second plural color image on the second side of said copy sheet with said copy sheet in said second orientation.

2. The duplex color printing system of claim 1, wherein said second plural color image is automatically correspondingly rotated by 90 degrees from said first plural color image for said printing of said second plural color image on said second side of said copy sheet with said copy sheet in said second orientation so that commonly oriented images are provided on said first and second sides of said copy sheet.

3. The duplex color printing system of claim 1, wherein said first orientation of said copy sheet is long edge first, and said second orientation is short edge first.

4. In a duplex color printing apparatus in which respective first and second plural color images are printed on both the first and second sides of copy sheets one side at a time in a duplex color printer, said duplex color printer including a printing sheet path and a duplex sheet path system for feeding sheets printed on their first sides back to be printed on their second sides;

the improvement for reducing copy sheet feeding jams due to color printing sheet curl, comprising:

wherein said printing sheet path of said duplex color printer feeds and prints said first plural color image on a first side of a copy sheet with said copy sheet in a first orientation and then feeds said copy sheet into said duplex sheet path system, and said duplex sheet path system includes a sheet rotation system which automatically rotates said copy sheet by 90 degrees from said first orientation into a second orientation and feeds said sheet in said second orientation back to said printing sheet path to print said second plural color image on the second side of said copy sheet with said copy sheet in said second orientation.

5. The duplex color printing system of claim 4, wherein said duplex color printer automatically electronically rotates said second plural color image by 90 degrees from said first plural color image for said printing of said second plural color image on said second side of said copy sheet corresponding with said rotation of said copy sheet in said second orientation so that commonly oriented images are provided on said first and second sides of said copy sheet.

6. The duplex color printing system of claim 4, wherein said first orientation of said copy sheet is long edge first, and said second orientation is short edge first.

* * * * *